US012798848B2

(12) United States Patent
Wu

(10) Patent No.: US 12,798,848 B2
(45) Date of Patent: Nov. 17, 2026

(54) PACKAGING MEMBER AND PACKAGING METHOD FOR PARALLEL LINK ROBOT

(71) Applicant: FANUC CORPORATION, Minamitsuru-gun (JP)

(72) Inventor: Zongpeng Wu, Yamanashi (JP)

(73) Assignee: FANUC CORPORATION, Minamitsuru-gun (JP)

( * ) Notice: Subject to any disclaimer, the term of this patent is extended or adjusted under 35 U.S.C. 154(b) by 0 days.

(21) Appl. No.: 19/119,468

(22) PCT Filed: Nov. 4, 2022

(86) PCT No.: PCT/JP2022/041144
§ 371 (c)(1),
(2) Date: Apr. 9, 2025

(87) PCT Pub. No.: WO2024/095442
PCT Pub. Date: May 10, 2024

(65) Prior Publication Data
US 2026/0131956 A1 May 14, 2026

(51) Int. Cl.
*B65D 57/00* (2006.01)
*B65D 5/50* (2006.01)
*B65D 85/64* (2006.01)

(52) U.S. Cl.
CPC ..... *B65D 57/00* (2013.01); *B65D 5/5028* (2013.01); *B65D 85/64* (2013.01); *B65D 2585/6875* (2013.01)

(58) Field of Classification Search
CPC ..... B25J 11/00; B25J 19/00
USPC ..... 206/305, 320
See application file for complete search history.

(56) References Cited

FOREIGN PATENT DOCUMENTS

| | | | | | |
|---|---|---|---|---|---|
| JP | S63-312085 | A | | 12/1988 | |
| JP | 2011-518052 | A | | 6/2011 | |
| JP | 2011-194534 | A | | 10/2011 | |
| JP | 2013-129007 | A | | 7/2013 | |
| JP | 2014240293 | A | * | 12/2014 | |
| JP | 2014240294 | A | * | 12/2014 | |
| JP | 2014240295 | A | * | 12/2014 | |
| JP | 2015229517 | A | * | 12/2015 | |
| WO | WO-2017221598 | A1 | * | 12/2017 | ..... B65D 81/113 |
| WO | 2021/251336 | A1 | | 12/2021 | |

* cited by examiner

*Primary Examiner* — Bryon P Gehman
(74) *Attorney, Agent, or Firm* — Renner, Otto, Boisselle & Sklar LLP

(57) ABSTRACT

A packaging member for a parallel link robot is removably assembled to a subassembly when the subassembly is packaged. The subassembly includes at least a pair of parallel passive links constituting the parallel link robot and at least one connecting member connecting the pair of passive links. The connecting member is a member that is connected to the pair of passive links so as to be rotatable about individual axes orthogonal to a plane including longitudinal axes of the pair of passive links and that can be disconnected when a spacing between the axes becomes less than or equal to a predetermined disassembly distance. The packaging member holds the pair of passive links at relative positions where the spacing is larger than the disassembly distance.

7 Claims, 12 Drawing Sheets

PACKAGING MEMBER AND PACKAGING METHOD FOR PARALLEL LINK ROBOT

This application is a national phase of International Patent Application No. PCT/JP 2022/041144, filed Nov. 4, 2022, which is hereby incorporated by reference in its entirety.

TECHNICAL FIELD

The present disclosure relates to a packaging member and a packaging method for a parallel link robot.

BACKGROUND ART

There is a known delta robot including three pairs of arm mechanisms connecting a base that is suspended and fixed to a frame and a bracket to which an end effector for performing work on a workpiece is attached (for example, see PTL 1).

The arm mechanisms each include one pair of link members disposed in parallel to each other with a spacing therebetween. A biasing member having hook-shaped hooks formed at both ends thereof is disposed between the link members. The hooks at both ends are hooked on bushes provided on the link members disposed at both sides of the biasing member, whereby the pair of link members are connected by the biasing member while being pulled in directions in which the link members come close to each other.

CITATION LIST

Patent Literature

{PTL 1} Japanese Unexamined Patent Application, Publication No. 2011-194534

SUMMARY OF INVENTION

According to one aspect, the present disclosure provides a packaging member for a parallel link robot, the packaging member being removably assembled to a subassembly when the subassembly is packaged. The subassembly includes at least a pair of parallel passive links constituting the parallel link robot and at least one connecting member connecting the pair of passive links, the connecting member is a member that is connected to the pair of passive links so as to be rotatable about individual axes orthogonal to a plane including longitudinal axes of the pair of passive links and that can be disconnected when a spacing between the axes becomes less than or equal to a predetermined disassembly distance, and the packaging member holds the pair of passive links at relative positions where the spacing is larger than the disassembly distance.

DESCRIPTION OF EMBODIMENTS

Figure 1:
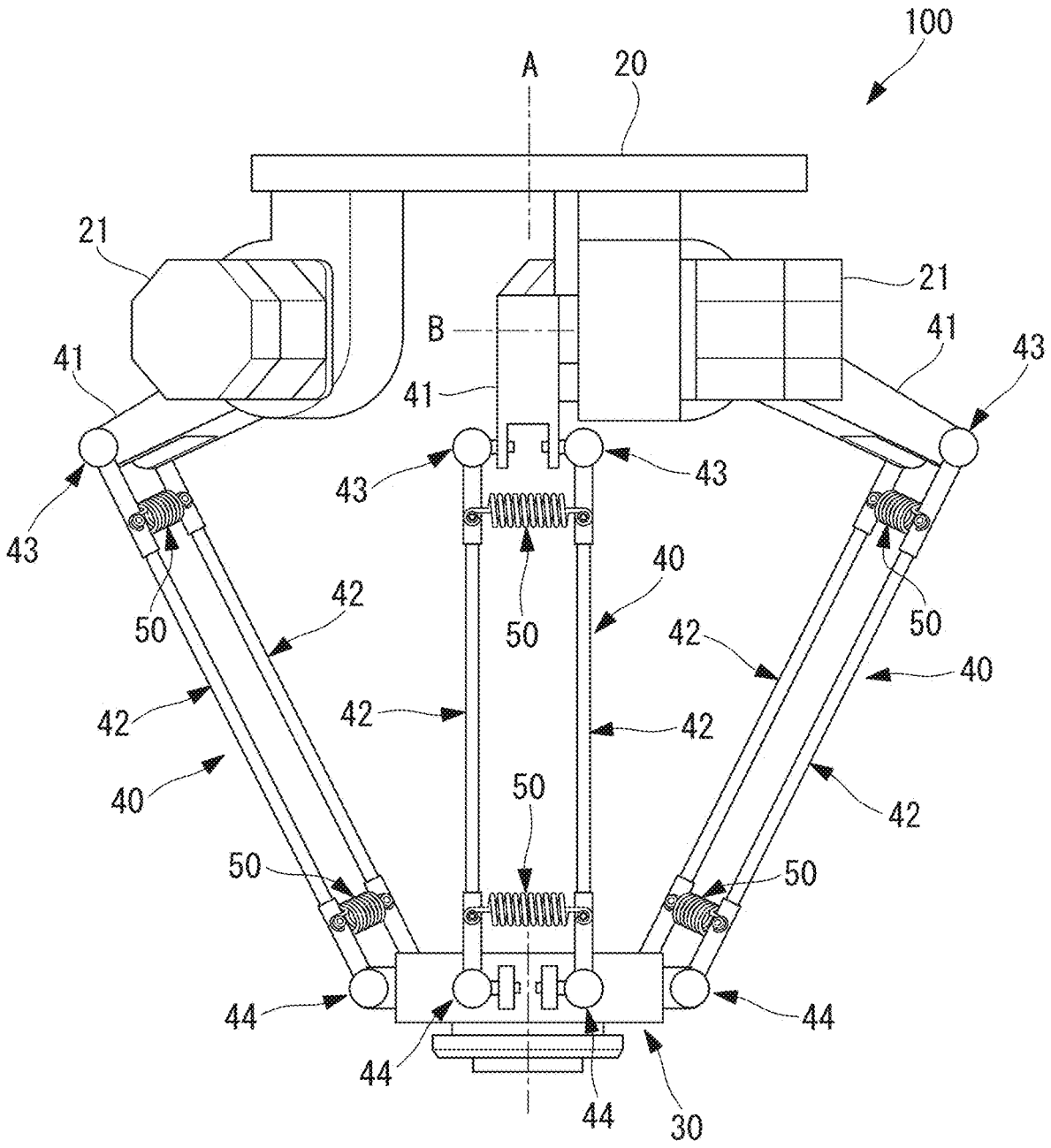
FIG. 1 is a front view showing a parallel link robot to which a packaging member according to a first embodiment of the present disclosure is applied.

A packaging member 1 and a packaging method for a parallel link robot 100 according to a first embodiment of the present disclosure will be described below with reference to the drawings.

First, the parallel link robot 100 (hereinafter, also referred to as robot 100), to which the packaging member 1 of this embodiment is applied, will be described on the basis of FIGS. 1 to 3.

The robot 100 includes, for example, a base part 20 that is suspended and fixed to a ceiling or the like, a movable part 30 that is disposed below the base part 20 with a spacing therebetween, and three pairs of arms 40 that connect the base part 20 and the movable part 30 in parallel.

Three servo motors 21 for individually driving the three pairs of arms 40 are installed on the base part 20. The individual servo motors 21 are arranged at equal spacings in the circumferential direction about an axis A that passes through the center of the base part 20 and that extends in the vertical direction. Furthermore, the servo motors 21 individually have shafts (not shown) that are rotated about horizontal axes B. The axes B extend along the tangential directions of the same circle centered on the axis A.

Figure 2:
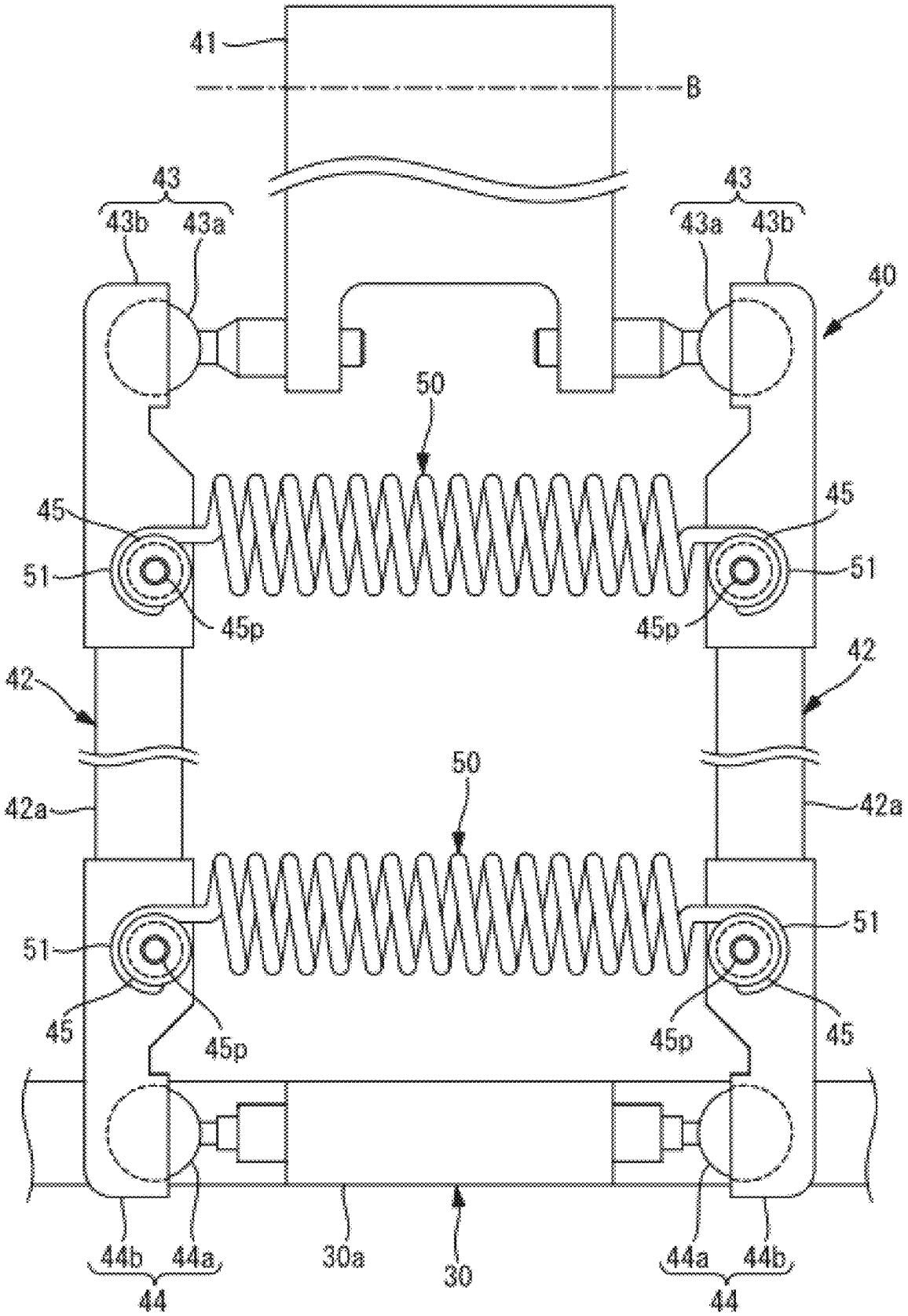
FIG. 2 is a front view showing a pair of passive links and biasing members in the parallel link robot shown in FIG. 1.

As shown in FIGS. 1 and 2, the arms 40 include driving links 41 that are individually connected to the shafts of the servo motors 21 via reducers (not shown) and that are thus rotationally driven about the axes B. Furthermore, the arms 40 each include a pair of passive links 42 disposed parallel to each other for connecting the corresponding driving link 41 and the movable part 30.

Each of the pair of passive links 42 includes a round-bar-shaped link body 42*a* and socket parts 43*b* and 44*b* fixed to both ends of the link body 42*a*.

Ball parts 43*a* are fixed at both ends of a distal end, in the direction of the axis B, of each of the driving links 41. Furthermore, on the circumference of the movable part 30, protruding parts 30*a* that protrude radially outward are provided at three locations equally spaced in the circumferential direction, and ball parts 44*a* are also fixed at both side surfaces of each of the protruding parts 30*a*.

The socket parts 43*b* at one end of each pair of passive links 42 are removably fitted onto the ball parts 43*a* on the corresponding driving link 41, whereby ball joints 43 are formed. Furthermore, the socket parts 44*b* at the other end of the pair of passive links 42 are removably fitted onto the ball parts 44*a* on the corresponding protruding part 30*a*, whereby ball joints 44 are formed.

Accordingly, the one end of each pair of passive links 42 and the corresponding driving link 41 are rotatably connected by the ball joints 43. Furthermore, the other end of the pair of passive links 42 and the movable part 30 are rotatably connected by the ball joints 44.

Pins 45*p* that extend in both directions orthogonal to a plane including the longitudinal axis of each pair of link bodies 42*a* are provided on the peripheries of the socket parts 43*b* and 44*b* of the pair of passive links 42. To the pins 45*p*, bushes 45 disposed coaxially with the corresponding pins 45*p* are attached so as to be rotatable about their central axes (axes).

Then, a biasing member (connecting member) 50 is disposed between the socket parts 43*b* of each pair of passive links 42, for pulling the socket parts 43*b* in the directions in which the socket parts 43*b* come close to each other, and another biasing member (connecting member) 50 is disposed between the socket parts 44*b* thereof, for pulling the socket parts 44*b* in the directions in which the socket parts 44*b* come close to each other.

Each of the biasing members 50 is a coil spring, for example, and includes hook-shaped hooks 51 at both ends thereof.

The hooks 51 at both ends of the biasing members 50 attached between one pair of passive links 42 in the state of being attached to the driving link 41 and the movable part 30 are individually hooked on the bushes 45 on the pair of socket parts 43*b* and the bushes 45 on the pair of socket parts 44*b*. At this time, the biasing members 50 in the state of being stretched slightly beyond the free length individually connect the socket parts 43*b* and 44*b*, to press the socket parts 43*b* and 44*b* against the ball parts 43*a* and 44*a*, respectively, in the direction of the axis B.

Therefore, in the state in which the robot 100 has been assembled, each pair of passive links 42 are pulled by the biasing members 50 in the directions in which the passive links 42 come close to each other, whereby the spacing between the passive links 42 is regulated so as not to widen. Furthermore, each of the biasing members 50 is maintained in a slightly stretched state, and inner surfaces of the hooks 51 at both ends are brought into close contact with outer circumferential surfaces of the corresponding bushes 45 by the elastic force corresponding to the amount of stretching of the biasing member 50.

That is, in the state in which the robot 100 has been assembled, the biasing members 50 maintain a situation in which the pair of passive links 42 do not come off the corresponding driving link 41 and the movable part 30. On the other hand, the distance between the central axes of each pair of pins 45*p*, which support the hooks 51 of each biasing member 50, is kept at a certain predetermined distance, whereby the biasing member 50 is held so as not to come off the bushes 45.

Furthermore, when the robot 100 is transported, the three pairs of passive links 42 can be removed from the base part 20 and the movable part 30. The distances between the socket parts 43*b* and between the socket parts 44*b* are increased against the elastic forces of the biasing members 50 by using a jig, for example, and the fittings of the socket parts 43*b* and 44*b* and the ball parts 43*a* and 44*a* are released. Accordingly, each pair of passive links 42 can be removed from the corresponding driving link 41 and the movable part 30.

When each pair of passive links 42 are removed from the corresponding driving link 41 or the movable part 30, the relative positional relationship between the passive links 42 due to the ball joints 43 and 44 is not maintained. That is, the distance between each pair of pins 45*p*, which support the hooks 51 at both ends of the biasing member 50, is reduced to a disassembly distance that is less than the predetermined distance, whereby the biasing member 50 can be easily removed from the passive links 42.

Figure 3:
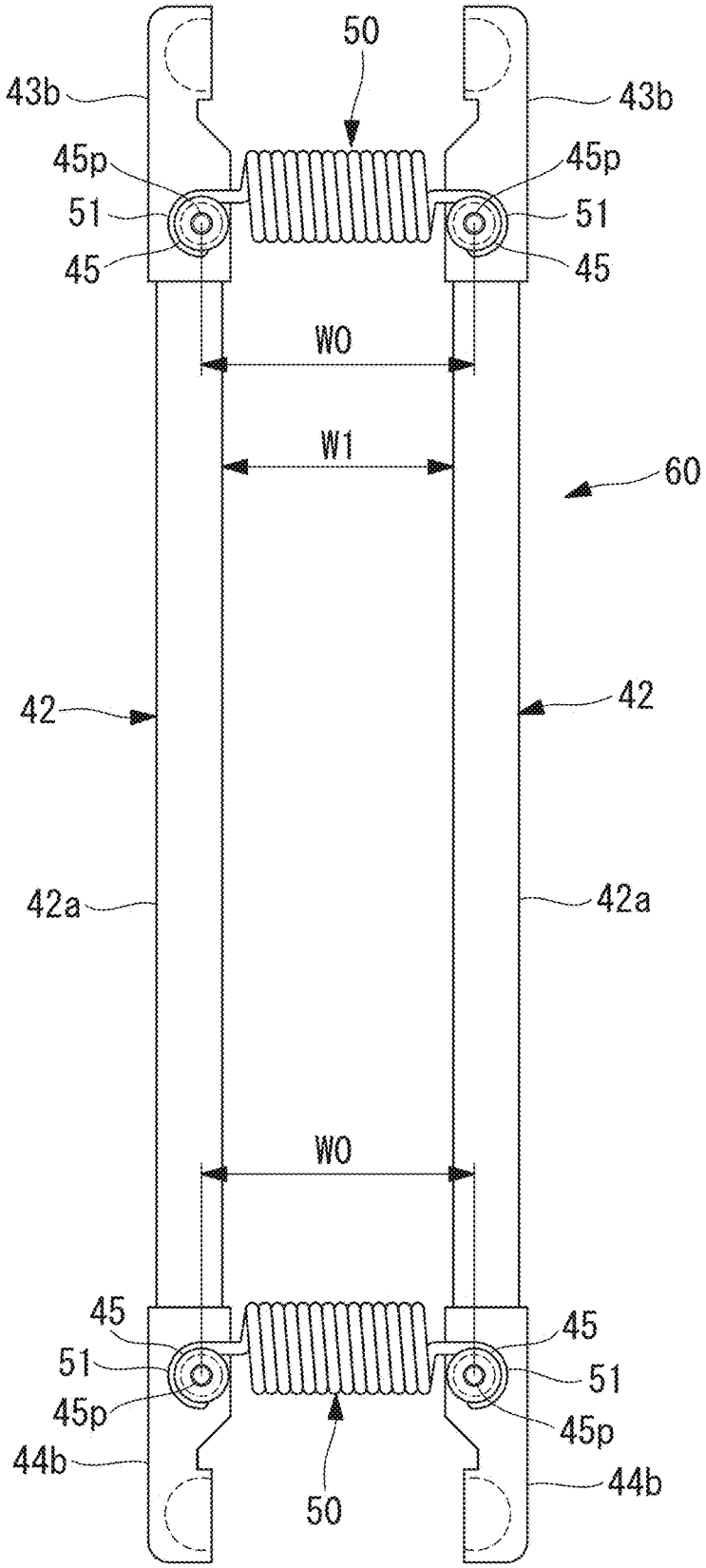
FIG. 3 is a front view showing a subassembly removed from the parallel link robot shown in FIG. 1.

Here, the disassembly distance is, for example, a distance W0 between the central axes of each pair of pins 45*p* obtained when the two biasing members 50 assembled to each pair of passive links 42 have free lengths, as shown in FIG. 3.

Next, the packaging member 1 according to the first embodiment of the present disclosure will be described on the basis of FIGS. 4 to 6.

Figure 4:
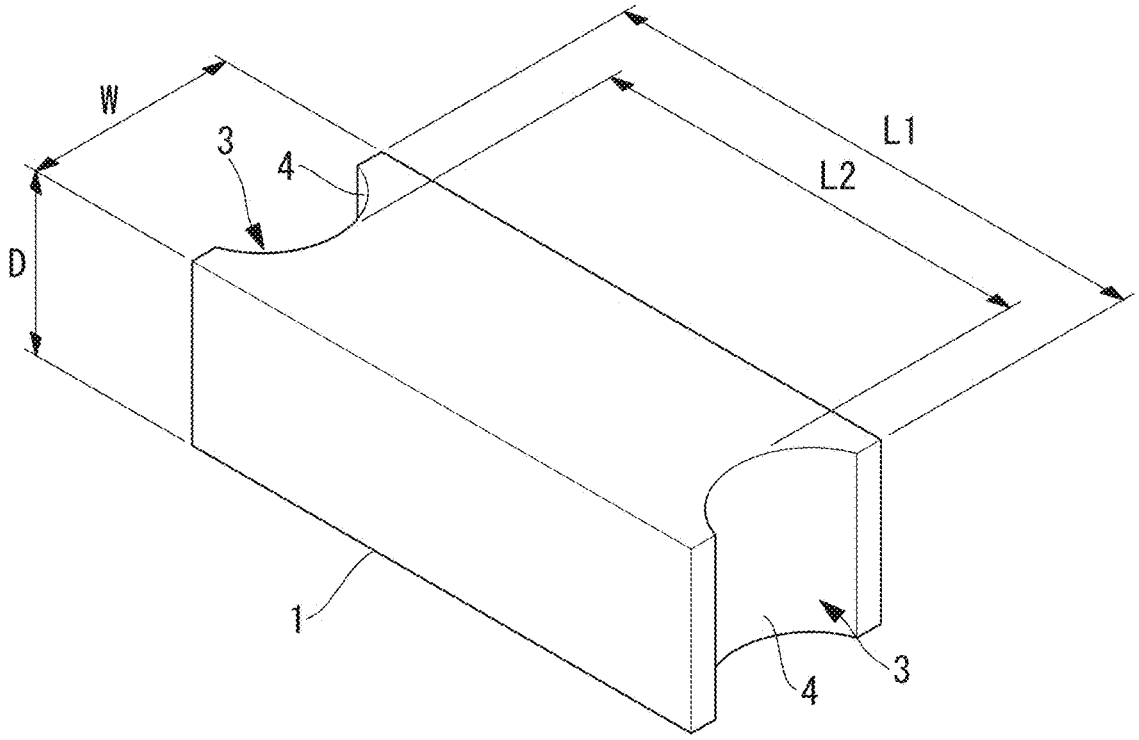
FIG. 4 is a perspective view showing the packaging member according to the first embodiment of the present disclosure.

The packaging member 1 is formed of an elastically deformable material, such as urethane foam, rubber, or Styrofoam, and is formed into a rectangular block having a length dimension L1, a width dimension W, and a thickness dimension D, for example, as shown in FIG. 4.

Figure 5:
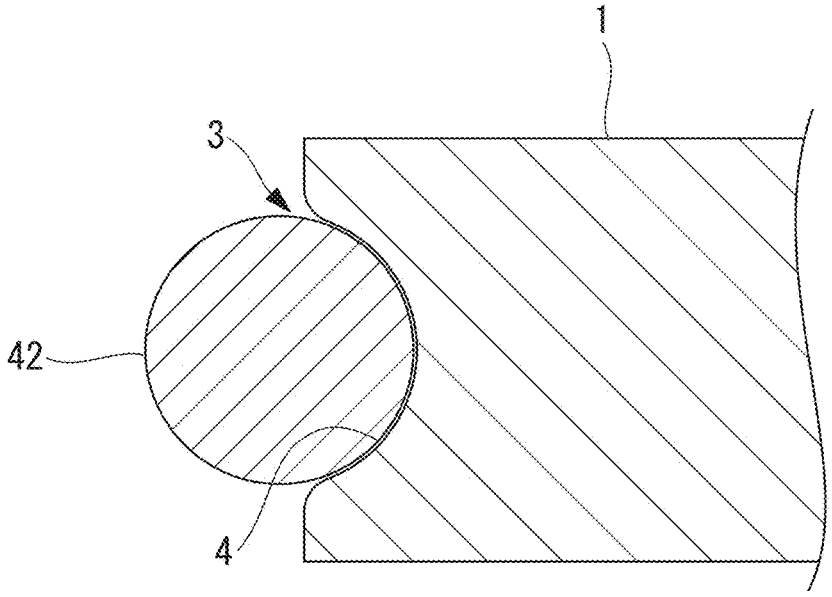
FIG. 5 is a cross-sectional view showing a state in which a passive link is fitted into a groove provided in the packaging member shown in FIG. 4.

As shown in FIGS. 4 and 5, at both ends of the packaging member 1 in the length direction, grooves 3 of which the cross-sectional shapes are substantially semicircular are formed along the thickness direction. Inner diameter dimensions of inner wall surfaces (contact surfaces) 4 of both grooves 3 are set to the same as outer diameter dimensions of the corresponding link bodies 42*a*. Furthermore, a distance L2 between the grooves 3 is set, for example, slightly larger than a distance W1 (see FIG. 3) between facing surfaces of both link bodies 42*a* obtained when the distance between the central axes of each pair of pins 45*p* of the pair of passive links 42 becomes the disassembly distance W0.

Furthermore, the thickness dimension D of the packaging member 1 is set as large as possible such that an operator can grasp the packaging member 1 with one hand and such that a diagonal dimension in the thickness and length directions becomes large enough with respect to the length dimension L1.

The packaging method used when the parallel link robot 100 is transported using the thus-structured packaging member 1 of this embodiment will be described below.

First, the spacing between each pair of passive links 42 assembled in the robot 100 is increased by using a tool, a special jig, or the like, whereby the individual ball joints 43 and 44 are disassembled. Accordingly, a subassembly 60 that is an assembly of a pair of passive links 42 and two biasing members 50 is removed from the driving link 41 and the movable part 30.

Here, since individual subassemblies 60 have the same structure, the packaging method for one subassembly 60 will be described below, and a description of the packaging method for the other two subassemblies 60 will be omitted.

In order to remove the subassembly 60, an operator applies, to the pair of link bodies 42*a* in the vicinity of the driving link 41, for example, forces in the directions in which the link bodies 42*a* are pulled apart from each other, to temporarily stretch the biasing member 50. Then, the socket parts 43*b* are separated from the ball parts 43*a*.

After that, in the state in which the socket parts 43*b* are separated from the ball parts 43*a*, the packaging member 1 is disposed between both link bodies 42*a*, and the forces applied to the link bodies 42*a* are released. Then, as shown in FIG. 5, the facing surfaces of the pair of link bodies 42*a* are brought into close contact with the inner wall surfaces 4 of the grooves 3 of the packaging member 1, from outer sides.

Similarly, the operator applies, to the pair of link bodies 42*a* in the vicinity of the movable part 30, forces in the directions in which the link bodies 42*a* are pulled apart from each other, to temporarily stretch the biasing member 50 and separate the socket parts 44*b* from the ball parts 44*a*. Then, in the state in which the socket parts 44*b* are separated from the ball parts 44*a*, another packaging member 1 is disposed between both link bodies 42*a*, and the facing surfaces of the link bodies 42*a* are brought into close contact with the inner wall surfaces 4 at both ends of the packaging member 1, from outer sides.

Figure 6:
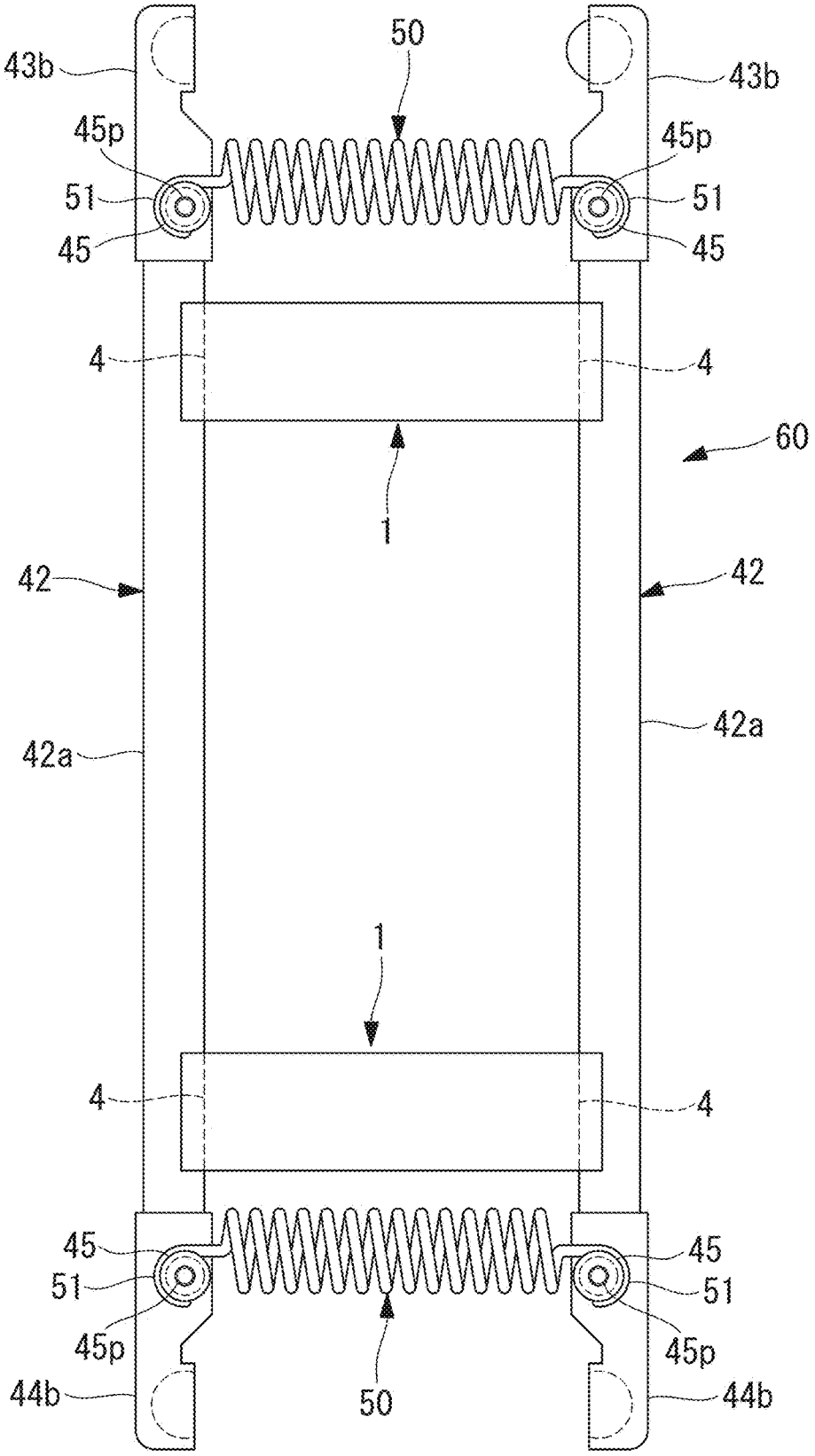
FIG. 6 is a front view showing a state in which two packaging members, which are identical to that shown in FIG. 4, are mounted in the subassembly shown in FIG. 3.

Accordingly, as shown in FIG. 6, the packaging members 1 individually disposed between the pair of passive links 42 in the vicinities of the socket parts 43*b* and 44*b* are sandwiched by the link bodies 42*a*. In this state, the biasing members 50 press, with the elastic forces thereof, the inner wall surfaces 4 of both grooves 3 of the individual packaging members 1.

On the other hand, the packaging members 1 push back outward the pair of link bodies 42*a* with elastic restoring forces thereof. Thus, the subassembly 60, which includes the pair of passive links 42 and the two biasing members 50, and the two packaging members 1 are held in an integrally assembled state, without being disassembled.

Furthermore, in this state, the distance between the facing surfaces of the pair of link bodies 42*a* is larger than the distance W1, and the spacings between the pairs of bushes 45 are also maintained in the state of being slightly larger than the disassembly distance W0. Therefore, even in the state of the subassembly 60, the biasing members 50 are held so as not to come off the passive links 42.

Figure 7:
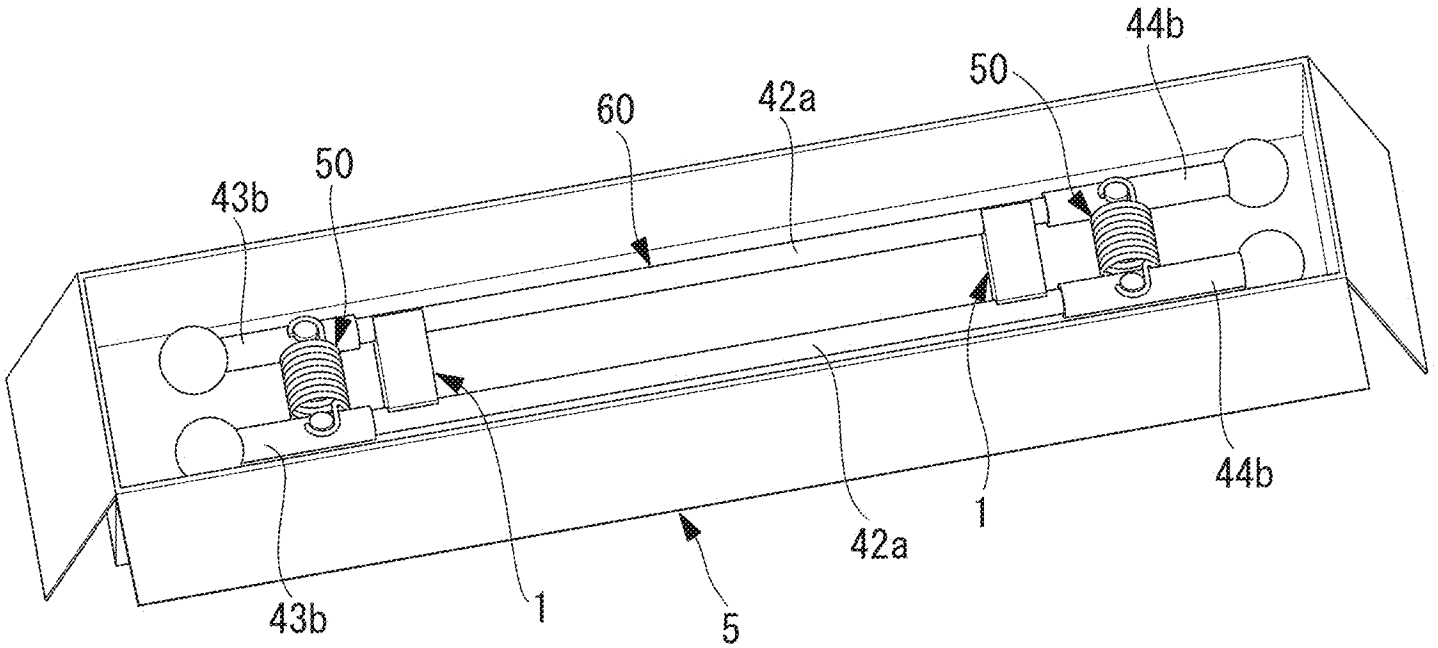
FIG. 7 is a perspective view showing a state in which the subassembly in which the packaging members are mounted as shown in FIG. 6 is accommodated in a packaging box.
Figure 8:
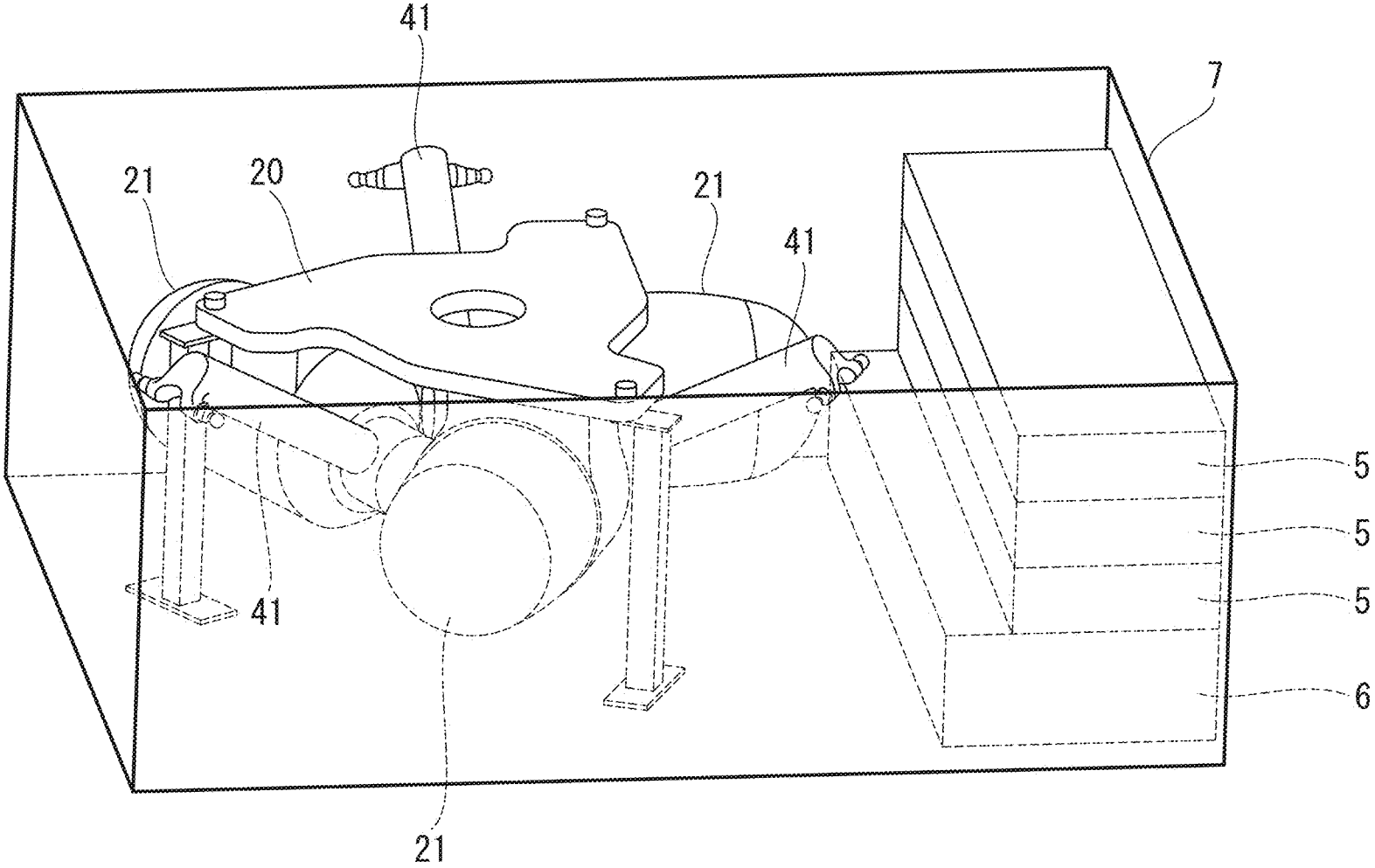
FIG. 8 is a perspective view showing an example packaging form for the parallel link robot shown in FIG. 1, using the packaging box shown in FIG. 7.

After that, the operator accommodates the subassembly 60 in the state in which the two packaging members 1 are sandwiched, in a packaging box 5, as shown in FIG. 7. Then, as shown in FIG. 8, the operator accommodates the packaging box 5 in which the subassembly 60 has been accommodated, in a larger packaging box 7 for accommodating the packaging box 5 together with the base part 20 to which the driving links 41 are connected and a packaging box 6 in which the movable part 30 etc. are accommodated. The other two subassemblies 60 are similarly accommodated in the packaging box 7. In the example shown in FIG. 8, three packaging boxes 5 are accommodated in a three-tier stacked form in the packaging box 7.

In this way, when the robot 100 is packaged, the individual subassemblies 60 are removed from the driving links 41 and the movable part 30, whereby the individual components can be made into more compact forms. Thus, space efficiency during transportation or storage can be improved, compared with a case in which the robot 100 is packaged without being disassembled.

Furthermore, since the packaging member 1 is set to a size that fits between a pair of passive links 42, it is sufficient that the packaging box 5 for accommodating each of the subassemblies 60 has a relatively small height dimension. Thus, as shown in FIG. 8, even when the three packaging boxes 5 are stacked in the height direction, a large space is not required, and the packaging box 7 can be made small.

Furthermore, since the thickness dimension D of the packaging member 1 is set large enough, even if forces act individually in the opposite longitudinal directions on the pair of passive links 42 with the packaging members 1 being sandwiched therebetween, the packaging members 1 will not fall over and come off. Accordingly, it is possible to stably maintain the subassembly 60 in an assembled state, thus facilitating handling of the subassembly 60.

In this way, by applying the packaging members 1 of this embodiment, even when the subassemblies 60 are removed from the robot 100, the biasing members 50 in the subassemblies 60 can be held in a slightly stretched state. That is, the spacings between the pairs of bushes 45 to which the biasing members 50 are attached can be held in the state of being larger than the disassembly distance W0. Thus, the biasing members 50 can be prevented from unintentionally coming off the subassembly 60.

Accordingly, when the robot 100 is transported with the subassemblies 60 removed therefrom, the biasing members 50 are in the state of being attached to the pairs of passive links 42, whereby the number of assembly man-hours for the robot 100 at the destination can be reduced.

Furthermore, since the packaging members 1 are sandwiched and fixed between each pair of passive links 42, the subassembly 60 and the packaging members 1 can be handled as an integrated object. That is, when each subassembly 60 is removed from the driving link 41 and the movable part 30, when the subassembly 60 is accommodated in the packaging box 5, or when the robot 100 is assembled at the destination, the subassembly 60 and the packaging members 1 can be handled in an integrated manner. Accordingly, it is possible to minimize the risk of losing the biasing members 50.

Furthermore, in this embodiment, since the inner wall surfaces 4 of the grooves 3 at both ends of the packaging member 1 have shapes that are brought into close contact with the outer circumferential surfaces of the corresponding link bodies 42*a*, the packaging member 1 can be more reliably fixed between the pair of link bodies 42*a*. Accordingly, when the subassembly 60 is handled, it is not necessary to be conscious of dropping out of the packaging member 1 from the pair of link bodies 42*a*.

Note that, in this embodiment, although the packaging member 1 is formed of an elastically deformable material, instead of this, the packaging member 1 may also be formed of a material that is not elastically deformed, such as rigid plastic or wood.

Figure 9:
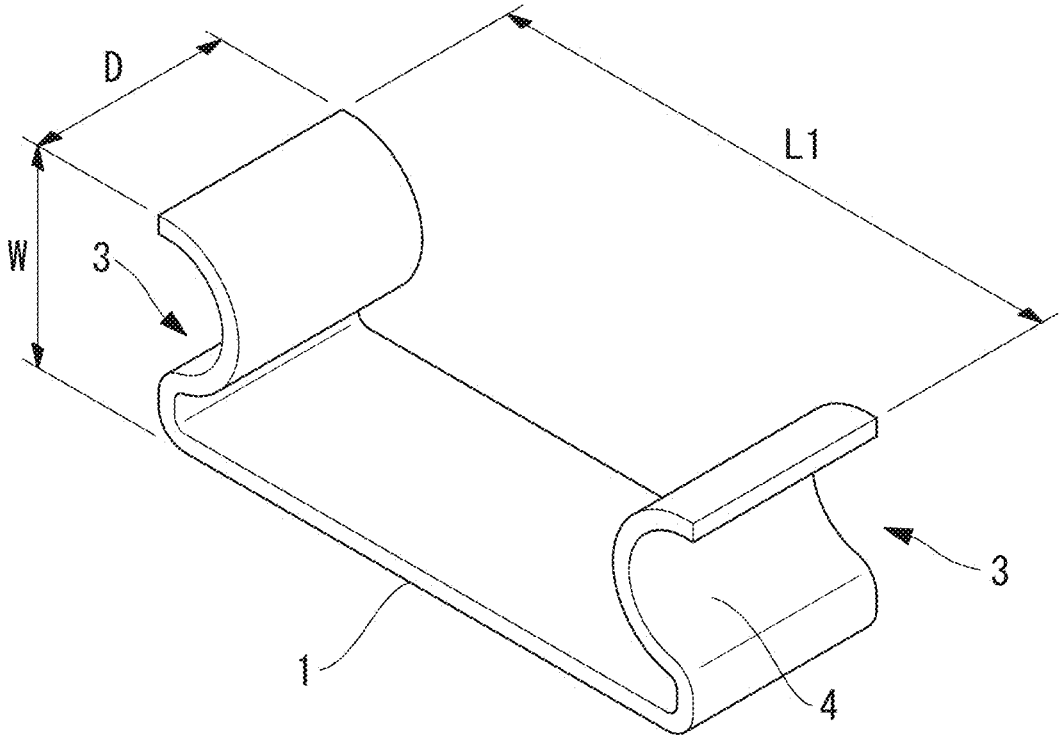
FIG. 9 is a perspective view showing a modification of the packaging member shown in FIG. 4.

Furthermore, although the packaging member 1 formed into a rectangular block has been illustrated, the present disclosure is not limited thereto. As shown in FIG. 9, it is also possible to adopt a packaging member 1 in which grooves 3 are formed at both ends thereof in the length direction by bending a sheet metal.

Furthermore, although the grooves of which the cross-sectional shapes are substantially semicircular have been illustrated above, it is also possible to adopt grooves having arbitrary shapes, such as V-shaped grooves, as long as the grooves are stably brought into close contact with the outer surfaces of the link bodies 42*a* of the passive links 42.

Figure 10:
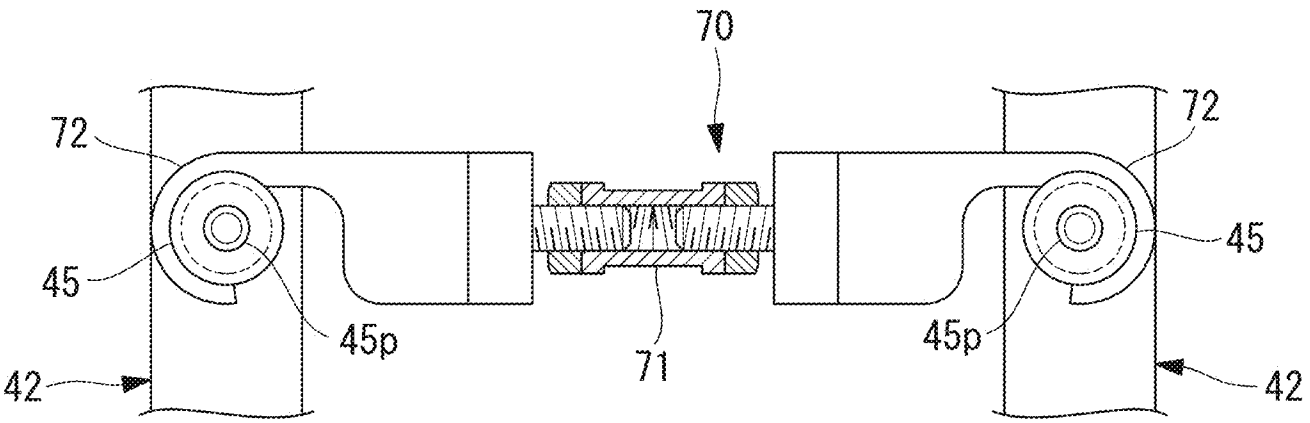
FIG. 10 is a partially enlarged view showing a modification of a connecting member in the parallel link robot shown in FIG. 1.

Furthermore, as shown in FIG. 10, the packaging members 1 may also be applied to a case in which the pair of passive links 42 are connected by, instead of the biasing members 50, connecting members 70 each including a screw mechanism 71 capable of adjusting the spacing between the passive links 42.

In the example shown in FIG. 10, hooks 72 at both ends of the connecting member 70 are hooked on the bushes 45, which are provided on the pair of passive links 42, so as to surround the bushes 45 from the outer sides in the spacing direction. That is, the screw mechanism 71 of the connecting member 70 is operated to increase the distance between the hooks 72, whereby the hooks 72 are separated from the outer circumferential surfaces of the bushes 45.

In this case, instead of a specific disassembly distance obtained when the biasing member 50 has the free length, the distance between the passive links 42 obtained in the state in which contacts between the bushes 45 on the passive links 42 and the hooks 72 are released becomes a disassembly distance. Therefore, the packaging members 1, which are formed of an elastic material or an inelastic material, are sandwiched between the pair of passive links 42, and the screw mechanism 71 is operated to pull the hooks 72, provided at both ends thereof, to each other. Accordingly, the spacing between the pair of passive links 42 is narrowed, whereby the packaging members 1 can be reliably sandwiched therebetween.

Furthermore, in this embodiment, although the biasing members 50 in the subassembly 60 in which the packaging members 1 have been sandwiched are stretched slightly beyond the free length, the biasing members 50 may be stretched largely beyond the free length.

For example, if the transportation time of the robot 100 is short, the packaging members 1 may be sandwiched, to increase the spacings between the pair of socket parts 43*b* and between the pair of socket parts 44*b* to the extent that those socket parts 43*b* and 44*b* can be assembled to the corresponding ball parts 43*a* and 44*a*, respectively.

In this case, when the robot 100 is assembled at the destination, the pairs of socket parts 43*b* and 44*b* just need to be brought close to the corresponding ball parts 43*a* and 44*a*, respectively, with the packaging members 1 sandwiched in the subassembly 60. Then, in the state in which the pairs of socket parts 43*b* and 44*b* are disposed at positions to sandwich the corresponding the ball parts 43*a* and 44*a*, respectively, the packaging members 1 are removed. Accordingly, the spacings between the pairs of socket parts 43*b* and 44*b* are reduced by the elastic forces of the biasing members 50, whereby the ball parts 43*a* and 44*a* are fitted into the socket parts 43*b* and 44*b*, respectively.

Therefore, when the robot 100 is assembled at the destination, since it is not necessary to use a jig or the like to increase the spacing between each pair of passive links 42, there is an advantage that the assembly work for the robot 100 can be performed more easily.

Figure 11:
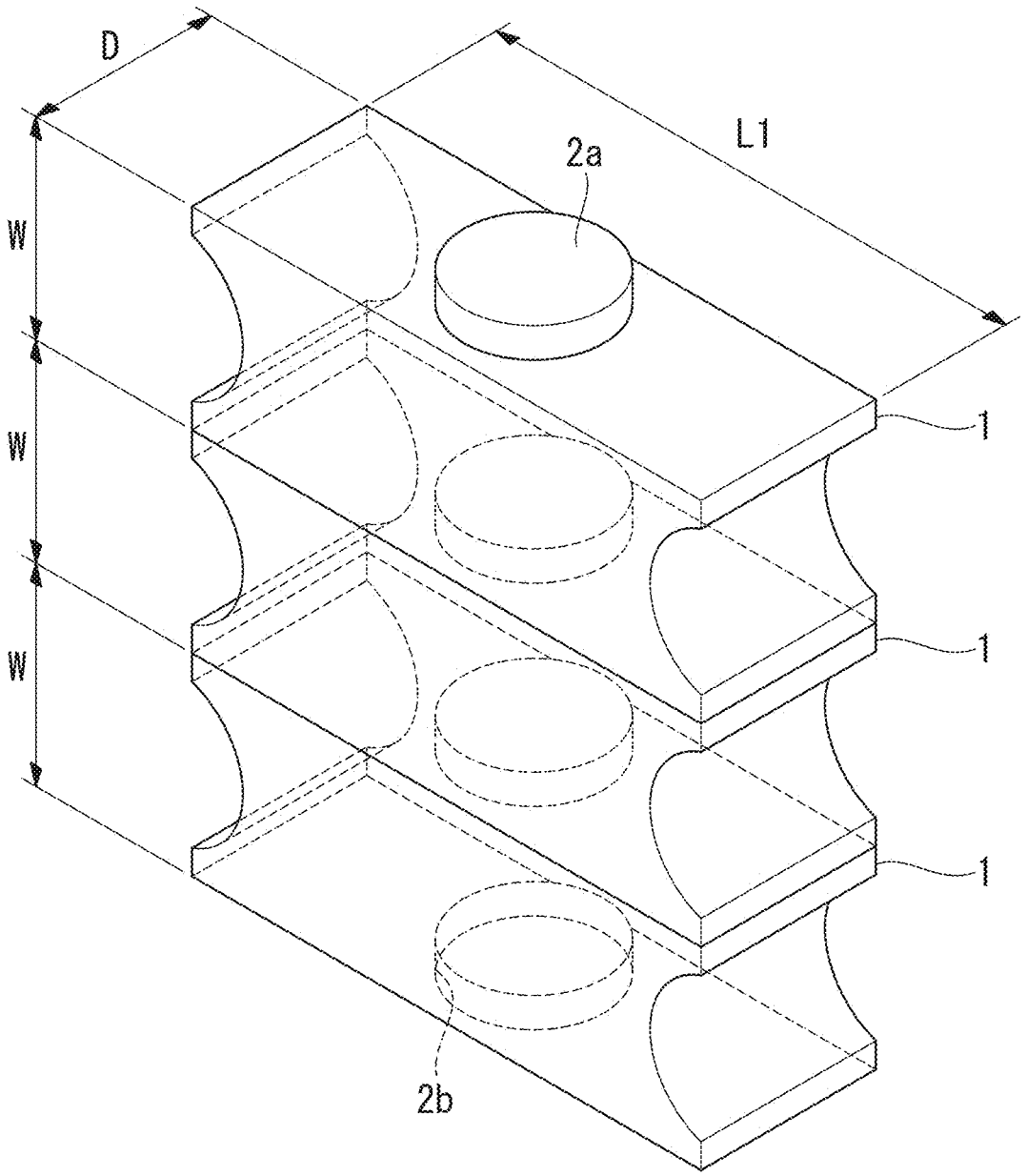
FIG. 11 is a perspective view showing a modification of the packaging member shown in FIG. 4.

Furthermore, as shown in FIG. 11, it is also possible to provide, on both side surfaces of the packaging member 1 in the width direction, a protruding part 2*a* and a recessed part 2*b* that are mutually mated when other packaging members 1 are stacked on the packaging member 1 in the width direction. In this case, the packaging members 1 are assembled at both ends of each of the three pairs of passive links 42 in three subassemblies 60, for example. After that, three packaging members 1 assembled at each of both ends of the three pairs of passive links 42 are stacked in the width direction. Then, the protruding parts 2*a* and the recessed parts 2*b* of the three packaging members 1 stacked in the width direction are mated with each other, whereby the three subassemblies 60 can be stacked and integrally combined in the width direction of the packaging members 1.

In this case, there is an advantage that the three subassemblies 60 can be accommodated in one packaging box 5 and packaged more compactly.

Furthermore, although the case in which a pair of grooves 3 are provided in the packaging member 1 has been illustrated, instead of this, a plurality of pairs of grooves 3 may be provided in the packaging member 1.

For example, it is also possible that the width dimension W of the packaging member 1 shown in FIG. 4 is increased by 3 times or more, and three pairs of grooves 3 are provided, on both side surfaces of the packaging member 1 in the length direction, at equal spacings along the width direction.

In this case, one common packaging member 1 is sandwiched between three pairs of passive links 42 at one ends, and the three pairs of link bodies 42*a* are fitted into the three pairs of grooves 3 provided in the packaging member 1. Similarly, another common packaging member 1 is sandwiched between the three pairs of passive links 42 at the other ends.

That is, with only two packaging members 1, all the spacings between the three pairs of link bodies 42*a* can be held in the state of being larger than the distance W1.

Furthermore, in this case, the three subassemblies 60 can be handled in an integrated manner and packaged more compactly.

Furthermore, in this embodiment, although two packaging members 1 are sandwiched between a pair of passive links 42, instead of this, one or three or more packaging members 1 may be sandwiched.

For example, when the packaging member 1 has a thickness dimension D almost the same as the length of a pair of link bodies 42*a*, only one packaging member 1 can be sandwiched between the pair of link bodies 42*a*, thus further improving work efficiency.

Next, a packaging member 10 and a packaging method according to a second embodiment of the present disclosure will be described below with reference to the drawings.

Since a description will be given below of a case in which a parallel link robot 100 that is the same as that described above is treated as a packaging target, identical reference numerals and signs are assigned to the components of the parallel link robot 100, and a description thereof will be omitted. Furthermore, identical reference numerals and signs are also assigned to the components of the packaging member 10 having the same structures as those of the above-described packaging member 1, and a description thereof will be omitted.

Figure 12:
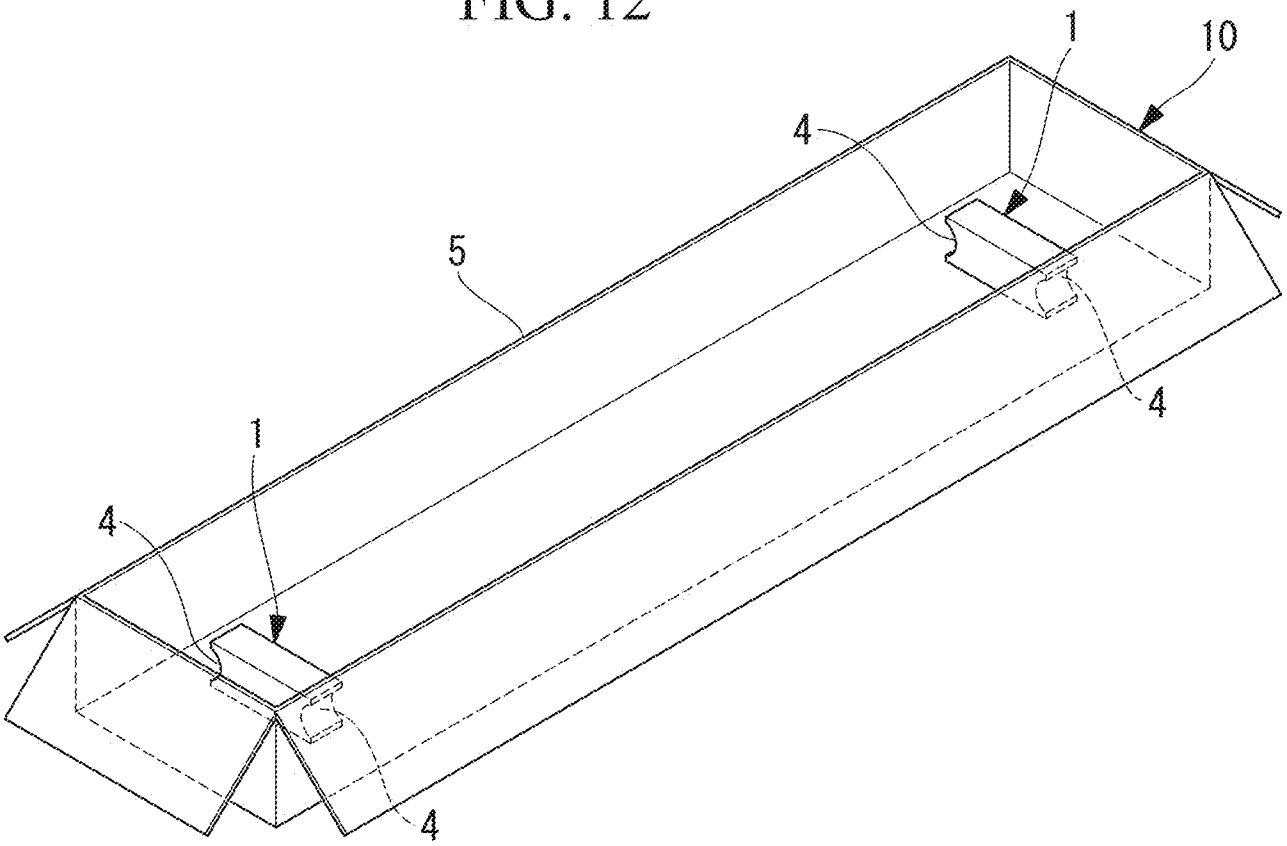
FIG. 12 is a perspective view showing a packaging member according to a second embodiment of the present disclosure.

As shown in FIG. 12, for example, the packaging member 10 of this embodiment is obtained by fixing two packaging members 1 on a bottom surface of a packaging box (box body) 5 for accommodating one subassembly 60.

The packaging box 5 is formed to a size that can accommodate one subassembly 60 with a slight gap therearound, for example.

The two packaging members 1 are disposed on the bottom surface inside the packaging box 5 with a spacing therebetween along the longitudinal direction of the packaging box 5 and are fixed thereto with an adhesive etc. Accordingly, the packaging members 1 are disposed at positions sandwiched between a pair of link bodies 42*a* in one subassembly 60 to be accommodated in the packaging box 5.

Therefore, when one subassembly 60 is accommodated in the packaging box 5, the facing surfaces of the pair of link bodies 42*a* are brought into close contact with the pairs of the inner wall surfaces 4 of the two packaging members 1, whereby the relative positional relationship between both link bodies 42*a* is held.

The packaging method for the parallel link robot 100 using the thus-structured packaging member 10 of this embodiment will be described below.

First, an operator removes three subassemblies 60 from the robot 100 in the same way as above.

After that, while one of the removed subassemblies 60 is being accommodated in the packaging box 5 with the spacing between the link bodies 42*a* held in the state of being larger than the distance W1, the two packaging members 1 on the bottom surface of the packaging box 5 are inserted between both link bodies 42*a*. The other two subassemblies 60 are packaged in the same way.

Accordingly, it is possible to simultaneously perform work for mounting the two packaging members 1 in the subassembly 60 and work for accommodating, in the packaging box 5, the subassembly 60 in which the packaging members 1 are mounted. Therefore, the packaging work becomes easier, whereby the time required for the packaging work can be reduced.

Note that, in this embodiment, it is also possible to raise or depress a section of the bottom surface inside the packaging box 5, to form contact surfaces 4.

Figure 13:
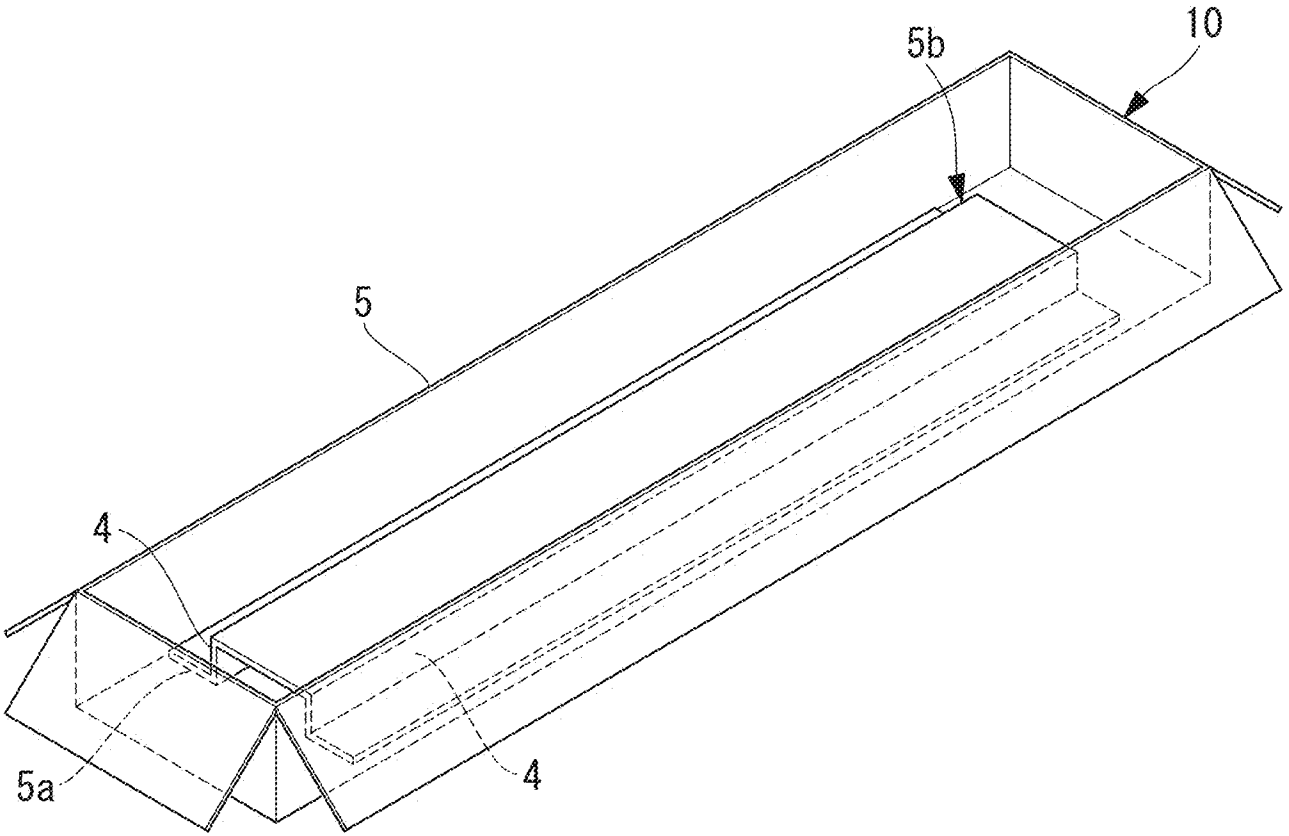
FIG. 13 is a perspective view showing a modification of the packaging member shown in FIG. 12.

For example, as shown in FIG. 13, the packaging box 5 may have a bank part 5*b* formed by bending a section of a bottom plate 5*a* along the width direction of the packaging box 5, the bottom plate 5*a* constituting the bottom surface.

In this case, the pair of contact surfaces 4 are formed on both sides of the bank part 5*b* in the width direction and are brought into contact with the facing surfaces of a pair of link bodies 42*a* in one subassembly 60 to be accommodated inside the packaging box 5. Accordingly, the distance between the link bodies 42*a* accommodated inside the packaging box 5 can be held in the state of being larger than the distance W1.

In this case, it is possible to eliminate the packaging members 1 and to reduce the cost of the packaging members 1. Thus, the total cost of the packaging member 10 is reduced, whereby the transportation cost of the robot 100 can be further reduced.

Although the embodiments of the present disclosure have been described above in detail, the present disclosure is not limited to the above-described individual embodiments. In these embodiments, various additions, replacements, modifications, and partial eliminations can be made without departing from the scope of the invention or without departing from the idea and the gist of the present invention derived from the content stated in the scope of claims and the equivalent thereof. For example, in the above-described embodiments, the order of operations and the order of processing procedures are shown as examples, and the present disclosure is not limited thereto.

The following notes are further disclosed in relation to the above-described embodiments and modifications.

(Note 1)

A packaging member (1) for a parallel link robot (100), the packaging member (1) being removably assembled to a subassembly (60) when the subassembly (60) is packaged. The subassembly (60) includes at least a pair of parallel passive links (42) constituting the parallel link robot (100) and at least one connecting member (50), (70) connecting the pair of passive links (42), the connecting member (50), (70) is a member that is connected to the pair of passive links (42) so as to be rotatable about individual axes orthogonal to a plane including longitudinal axes of the pair of passive links (42) and that can be disconnected when a spacing between the axes becomes less than or equal to a predetermined disassembly distance (W0), and the packaging member (1) holds the pair of passive links (42) at relative positions where the spacing is larger than the disassembly distance (W0).

(Note 2)

The packaging member (1) for a parallel link robot (100), according to note 1, wherein the packaging member (1) is assembled to the subassembly (60) at a position sandwiched between the pair of passive links (42), and the packaging member (1) includes a pair of contact surfaces (4) that are brought into contact with facing surfaces of the pair of passive links (42).

(Note 3)

The packaging member (1) for a parallel link robot (100), according to note 2, wherein the contact surfaces (4) have shapes that can be brought into close contact with the facing surfaces of the pair of passive links (42).

(Note 4)

The packaging member (1) for a parallel link robot (100), according to note 2 or 3, wherein the packaging member (1) is formed of an elastically deformable material.

(Note 5)

The packaging member (1) for a parallel link robot (100), according to one of notes 1 to 4, wherein the packaging member (1) is fixed to a bottom surface of a box body (5) that can accommodate the subassembly (60).

(Note 6)

The packaging member (1) for a parallel link robot (100), according to one of notes 1 to 4, wherein the packaging member (1) is formed integrally on a bottom surface of a box body (5) that can accommodate the subassembly (60).

(Note 7)

A packaging method for packaging a subassembly (60) including at least a pair of parallel passive links (42) constituting a parallel link robot (100) and at least one connecting member (50), (70) connecting the pair of passive links (42). The connecting member (50), (70) is a member that is connected to the pair of passive links (42) so as to be rotatable about individual axes orthogonal to a plane including longitudinal axes of the pair of passive links (42) and that can be disconnected when a spacing between the axes becomes less than or equal to a predetermined disassembly distance (W0). The packaging method includes removably assembling, to the subassembly (60), a packaging member (1) that holds the pair of passive links (42) at relative positions where the spacing is larger than the disassembly distance (W0).

REFERENCE SIGNS LIST

1 packaging member
3 groove
4 inner wall surface (contact surface)
5 packaging box (box body)
10 packaging member
42 passive link
50 biasing member (connecting member)
60 subassembly
70 connecting member
100 parallel link robot
W0 disassembly distance

The invention claimed is:

1. A packaging member for a parallel link robot, the packaging member being removably assembled to a subassembly when the subassembly is packaged, wherein the subassembly includes at least a pair of parallel passive links constituting the parallel link robot and at least one connecting member connecting the pair of passive links, the at least one connecting member is a member that is connected to the pair of passive links so as to be rotatable about individual axes orthogonal to a plane including longitudinal axes of the pair of passive links and that can be disconnected when a spacing between the axes orthogonal to the plane becomes less than or equal to a predetermined disassembly distance, and the packaging member holds the pair of passive links at relative positions where the spacing is larger than the disassembly distance.

2. The packaging member for a parallel link robot, according to claim 1, wherein the packaging member is assembled to the subassembly at a position sandwiched between the pair of passive links, and the packaging member comprises a pair of contact surfaces that are brought into contact with facing surfaces of the pair of passive links.

3. The packaging member for a parallel link robot, according to claim 2, wherein the contact surfaces have shapes that can be brought into close contact with the facing surfaces of the pair of passive links.

4. The packaging member for a parallel link robot, according to claim 2, wherein the packaging member is formed of an elastically deformable material.

5. The packaging member for a parallel link robot, according to claim 1, wherein the packaging member is fixed to a bottom surface of a box body that can accommodate the subassembly.

6. The packaging member for a parallel link robot, according to claim 1, wherein the packaging member is formed integrally on a bottom surface of a box body that can accommodate the subassembly.

7. A packaging method for packaging a subassembly including at least a pair of parallel passive links constituting a parallel link robot and at least one connecting member connecting the pair of passive links, wherein the at least one connecting member is a member that is connected to the pair of passive links so as to be rotatable about individual axes orthogonal to a plane including longitudinal axes of the pair of passive links and that can be disconnected when a spacing between the axes orthogonal to the plane becomes less than or equal to a predetermined disassembly distance, the packaging method comprises removably assembling, to the subassembly, a packaging member that holds the pair of passive links at relative positions where the spacing is larger than the disassembly distance.

* * * * *